US010876278B2

(12) United States Patent
Kennedy

(10) Patent No.: US 10,876,278 B2
(45) Date of Patent: Dec. 29, 2020

(54) MAIN VALVE SEAL GUIDE RIBS

(71) Applicant: Kennedy Valve Company, Elmira, NY (US)

(72) Inventor: Paul Kennedy, Horseheads, NY (US)

(73) Assignee: Kennedy Valve Company, Elmira, NY (US)

( * ) Notice: Subject to any disclaimer, the term of this patent is extended or adjusted under 35 U.S.C. 154(b) by 0 days.

(21) Appl. No.: 16/135,249

(22) Filed: Sep. 19, 2018

(65) Prior Publication Data

US 2020/0087896 A1 Mar. 19, 2020

(51) Int. Cl.
*E03B 7/07* (2006.01)
*E03B 7/08* (2006.01)

(52) U.S. Cl.
CPC ..... *E03B 7/078* (2013.01); *E03B 7/071* (2013.01); *E03B 7/08* (2013.01)

(58) Field of Classification Search
CPC . E02B 9/02; E03B 7/078; E03B 7/071; E03B 7/08
USPC ..... 251/333
See application file for complete search history.

(56) References Cited

U.S. PATENT DOCUMENTS 2,100,862 A * 11/1937 Lofton ..... E03B 9/02 137/298
3,599,662 A * 8/1971 Dashner ..... E03B 9/14 137/257
4,790,342 A * 12/1988 Segal ..... E03B 9/02 137/15.02
5,441,074 A * 8/1995 Kjaer ..... E03B 9/08 137/283
6,058,957 A * 5/2000 Honigsbaum ..... E03B 9/02 137/1

FOREIGN PATENT DOCUMENTS

GB 854810 * 11/1960 ..... E03B 9/02

* cited by examiner

*Primary Examiner* — Kevin R Barss
(74) *Attorney, Agent, or Firm* — Brown & Michaels, PC

(57) ABSTRACT

In an embodiment, a fire hydrant elbow includes a first portion joined with a second portion, the second portion having a center axis angled from a center axis of the first portion. A main valve seat faces radially inward toward the first center axis from the first annular wall, the main valve seat defining a step from a first radius to a second radius, the first radius being larger than the second radius. A guide rib is adjacent the main valve seat between the first portion and the second portion, the guide rib protruding radially inward toward the first center axis.
In another embodiment, a main valve seal guide for a fire hydrant includes an annular body and a plurality of guide ribs coupled to the annular body. Each guide rib has a first surface, and each guide rib extends from the annular body to the first surface.

20 Claims, 6 Drawing Sheets

MAIN VALVE SEAL GUIDE RIBS

BACKGROUND OF THE INVENTION

Field of the Invention

The invention pertains to the field of fire hydrants. More particularly, the invention pertains to a guide rib to guide a fire hydrant main valve.

Description of Related Art

A dry-barrel fire hydrant is particularly well suited to colder climates where low temperatures can freeze water in a hydrant and block the flow of water to the hydrant's outlets. In a dry-barrel fire hydrant, an above-ground portion of the hydrant is separated from a pressurized water source by a main valve in a lower barrel or an elbow of the hydrant below ground. The upper barrel remains dry until the main valve is opened by means of a long stem that extends from the main valve, through the upper barrel, to the top, or bonnet, of the hydrant.

FIG. 1 is a cross-section of a conventional fire hydrant 10. Referring to FIG. 1, an upper barrel 10, generally made of cast iron, is installed above ground level and is provided with outlet ports 12 for attachment of fire hoses. A barrel cap 14 at the top of the upper barrel 10 houses an operating stem nut 16, which can be turned to open or close the flow of water into the hydrant 1.

The upper barrel 10 is connected to one end of a lower barrel 20 via a coupling element 22, generally of a break-away design such that the upper barrel 10 can separate from the lower barrel 20 cleanly at the coupling element 22, for example, if struck by an automobile. The lower barrel 20 provides a conduit through which water (or another fluid) can flow from a location below the frost line, to the upper barrel 10 where the water is needed for subsequent use in firefighting.

The other end of the lower barrel 20 is similarly connected via a mating flange 24 to a first mating flange 31 of an elbow 30 containing the hydrant's main valve assembly 40. The elbow 30 and the main valve assembly 40 are shown in greater detail in FIG. 2. The elbow 30 can also be connected to a water main via an intervening gate valve (not shown) that can isolate the hydrant 1 from the water main during installation, repair, or replacement of the hydrant 1. In this embodiment, a second flange 32 of the elbow 30 is provided on one end of the elbow 30 for this purpose.

The operating stem nut 16 in the barrel cap 14 is threaded to a first end 51 of an operating stem 50, which includes an upper stem 52, a lower stem 54, and a breaking stem coupling element 56. The operating stem 50 traverses inside the upper barrel 10 and the lower barrel 20, and is connected to the main valve assembly 40 inside the elbow 30 at a second end 57 opposite the first end 51. Turning the operating stem nut 16 raises and lowers the operating stem 50 and thus the main valve assembly 40, including a main valve seal 41, against or away from a main valve seat 42, which is located in the elbow 30 below the first mating flange 31 of the elbow 30. A valve seat insert 43 is inset in, and sealed against, the elbow 30, above the level of the main valve seal 41, and the main valve seat 42 is set and sealed against the valve seat insert 43, such that when the main valve seal 41 closes and seals against the main valve seat 42, water is sealed in the elbow 30 below the main valve seal 41 and the main valve seat 42. Thus, the elbow 30 has a "wet" side, below the main valve seal 41 and the main valve seat 42, and a "dry" side above the main valve seal 41 and the main valve seat 42.

Drain holes 34 located through the elbow 30 and the main valve seat 42, allow the upper barrel 10 and lower barrel 20 to drain water to surrounding gravel beds or concrete basins when the hydrant main valve seal 41 is closed against the main valve seat 33 after use. Hence, the term "dry barrel" hydrant is applied, as no water remains present in the hydrant's upper barrel 10 and lower barrel 20 when the main valve seal 41 in the elbow 32 is closed against the main valve seat 42.

The main valve seal 41 is disposed between a main valve bottom plate 44 below the main valve seal 41, and a drain valve body 45 above the main valve seal 41. The lower stem 54 passes through the drain valve body 45, and the main valve seal 41, and is threaded into the main valve bottom plate 44. Once assembled, a drain valve pin 46 inserted through the drain valve body 45 and the lower stem 54 prevents rotation of the lower stem 54 relative to the main valve bottom plate 44 during operation.

The drain holes 34 are open to the inner volume of water above the main valve seal 41 when the main valve seal 41 is closed against the main valve seat 42, and the upper barrel 10 and lower barrel 20 are allowed to drain (see arrows). The drain valve body 45 is also provided with a drain valve facing 47, and a rubber boss 48, which biases the drain valve facing 47 to move outwardly toward the main valve seat 42. When the main valve seal 41 is opened by downward movement of the lower stem 54, the drain valve body 45 also moves downwardly such that the drain valve facing 47 is moved over the drain holes 34 in the elbow 30. The drain valve facing 47 is then held against the drain holes 34 by bias of the rubber boss 48 and high pressure water flowing past the main valve seal 41, effectively blocking the flow of water out of the drain holes 34 in the elbow 30.

When the operating stem nut 16 is turned to raise the operating stem 50, and to close the main valve assembly 40 against the main valve seat 42, as the main valve seal 41 approaches the main valve seat 42, the decreased pressure caused by water rushing between the main valve seat 42 and the main valve seal 41 pulls and/or stretches the main valve seal 41 toward the main valve seat 42, causing the main valve seal 41 to flutter or oscillate rapidly against and apart from the main valve seat 42. This fluttering or oscillating movement of the main valve seal 41 interrupts the steady flow of water (or other fluid) past the main valve assembly 40 into the lower barrel 20, causing turbulence and vibration, which in turn can be disruptive to a fire hydrant operator, and can cause extra wear on fire hydrant components.

FIG. 3 shows an alternative prior art elbow 60 and main valve assembly 70. In this embodiment, a main valve seat 62 is integral with the elbow 60, and no valve seat insert is necessary. A main valve seal 72 closes against the main valve seat 62. An elbow drain hole 64 is equipped with a drain hole bushing 80 and a hollow drain hole stem 82, which can be adjusted within the drain hole 64 to seal against a drain valve facing 74 of a drain valve body 76 when the main valve assembly 70 is in an open position to allow fluid to flow through the elbow 60 into a lower barrel 90. FIG. 3 shows the main valve assembly 70 in a closed position, with the elbow drain hole 64, the drain hole bushing 80, and the drain hole stem 82 aligned with a drain body drain hole 78, enabling fluid to flow from the lower barrel 90 through the drain body drain hole 78 and the elbow drain hole 64.

Here again, when the main valve seal 72 is closing toward the main valve seat 62, as the main valve seal 72 approaches the main valve seat 62, the decreased pressure caused by water rushing between the main valve seat 62 and the main valve seal 72 stretches the main valve seal 72 toward the main valve seat 62, causing the main valve seal 72 to flutter or oscillate rapidly against and apart from the main valve seat 62. This oscillating stretching of the main valve seal 72 to hit the main valve seat 62 interrupts the steady flow of fluid past the main valve assembly 70 into the lower barrel 90.

SUMMARY OF THE INVENTION

In an embodiment, a fire hydrant elbow includes: a first portion including a first annular wall around a first center axis; a second portion including a second annular wall around a second center axis, the second portion joined with the first portion, the second center axis angled from the first center axis; a main valve seat facing radially inward toward the first center axis from the first annular wall, the main valve seat defining a step from a first radius to a second radius, the first radius being larger than the second radius; and a guide rib adjacent the main valve seat between the first portion and the second portion, the guide rib protruding radially inward toward the first center axis.

In another embodiment, a fire hydrant includes an elbow including an inner circumference and a main valve seat around the inner circumference; and a main valve assembly in the elbow, the main valve assembly including a main valve seal, the main valve seal configured to abut and seal against an inner circumference of the main valve seat, a guide rib adjacent the main valve seat, the guide rib having an innermost radius greater than an inner radius of the main valve seat, the innermost radius of the guide rib being smaller than an outer radius of the main valve seal.

In another embodiment, a main valve seal guide for a hydrant includes:

an annular body having a center axis; and a plurality of guide ribs coupled to the annular body, each guide rib having a first surface, each guide rib extending from the annular body to the first surface, the first surface of each guide rib being within ten degrees of parallel with the center axis.

DETAILED DESCRIPTION OF THE INVENTION

Figure 1:
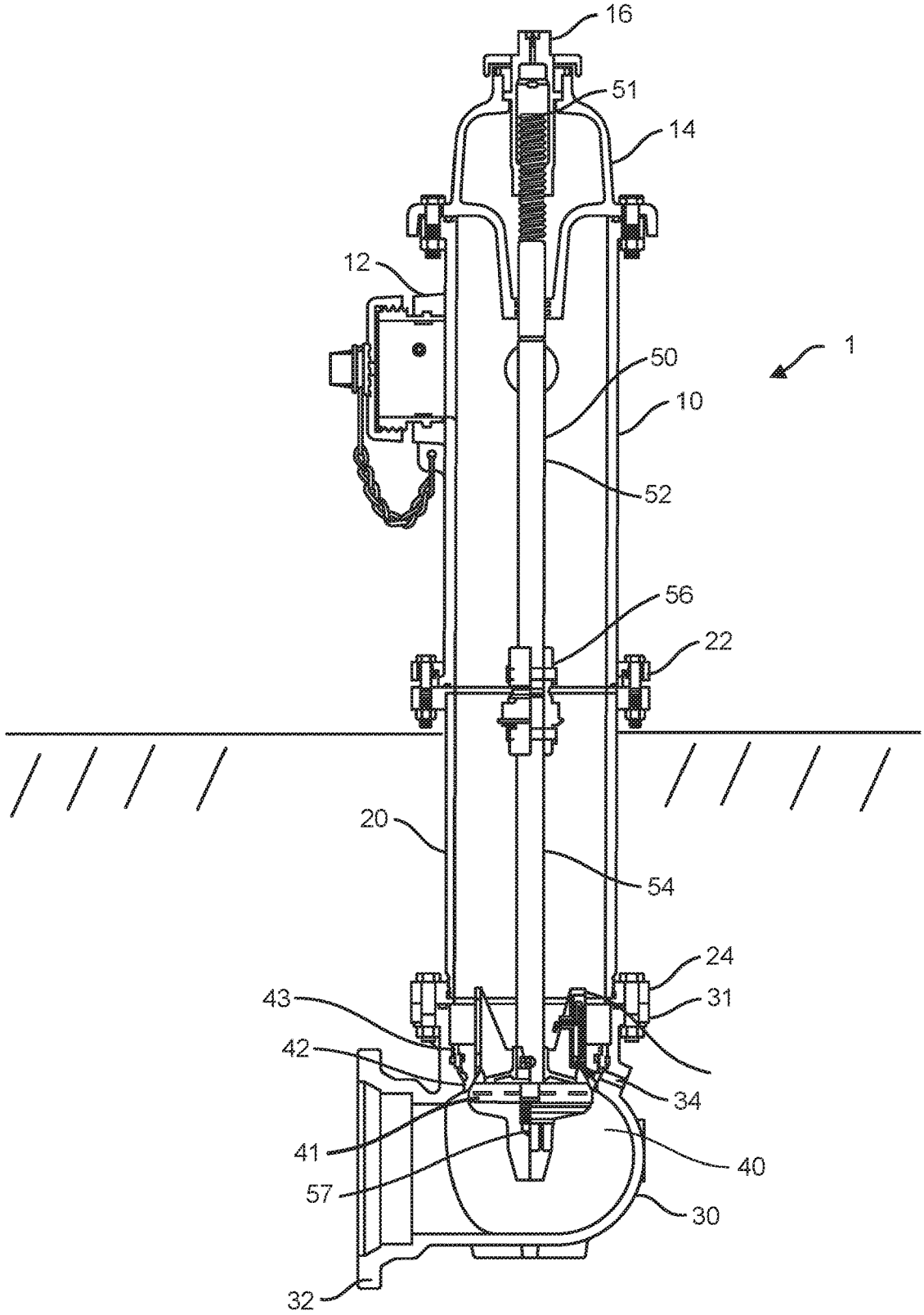
FIG. 1 PRIOR ART
FIG. 1 shows a conventional fire hydrant.
Figure 2:
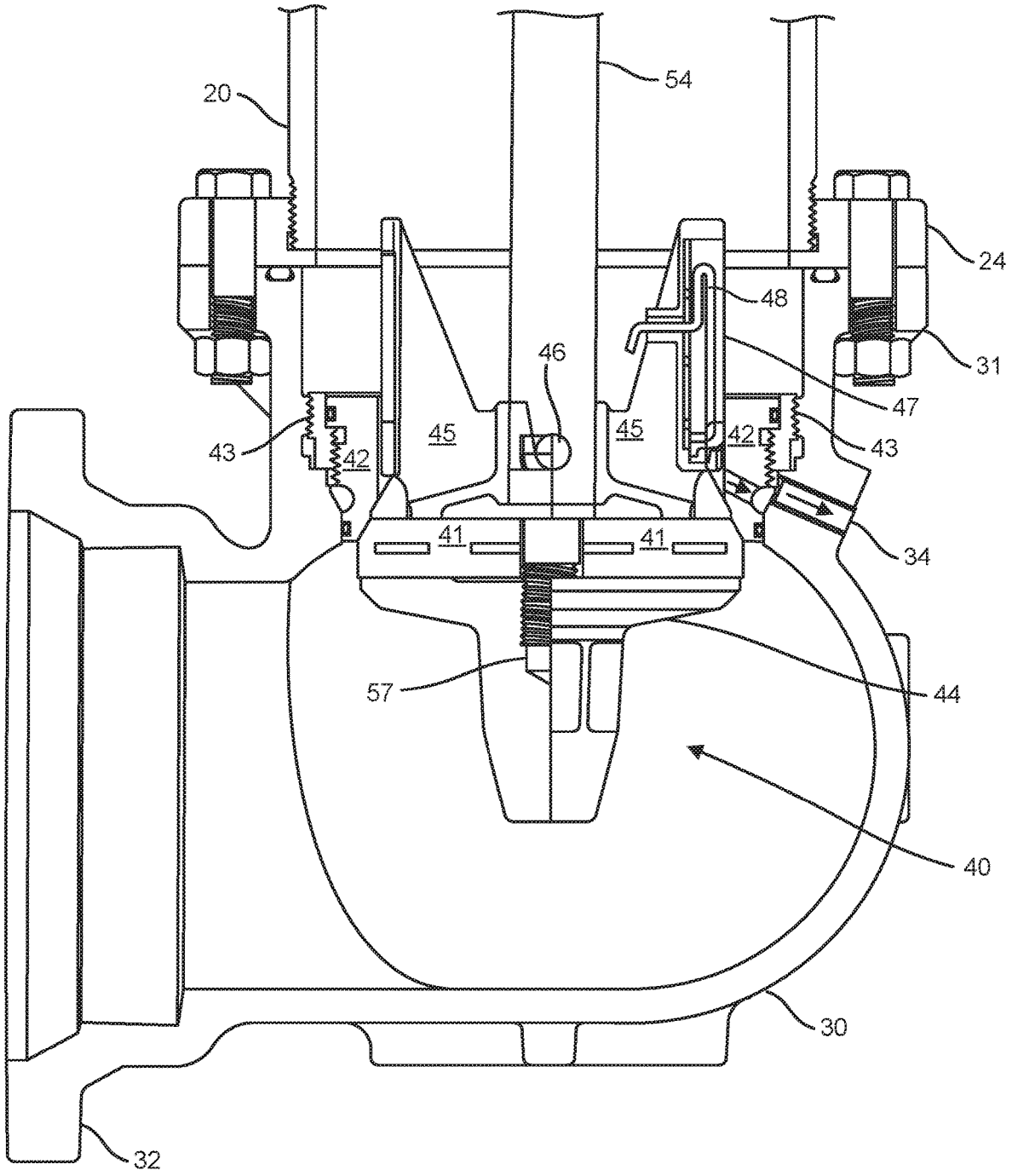
FIG. 2 PRIOR ART
FIG. 2 shows a detailed view of an elbow and main valve assembly of the fire hydrant of FIG. 1.
Figure 3:
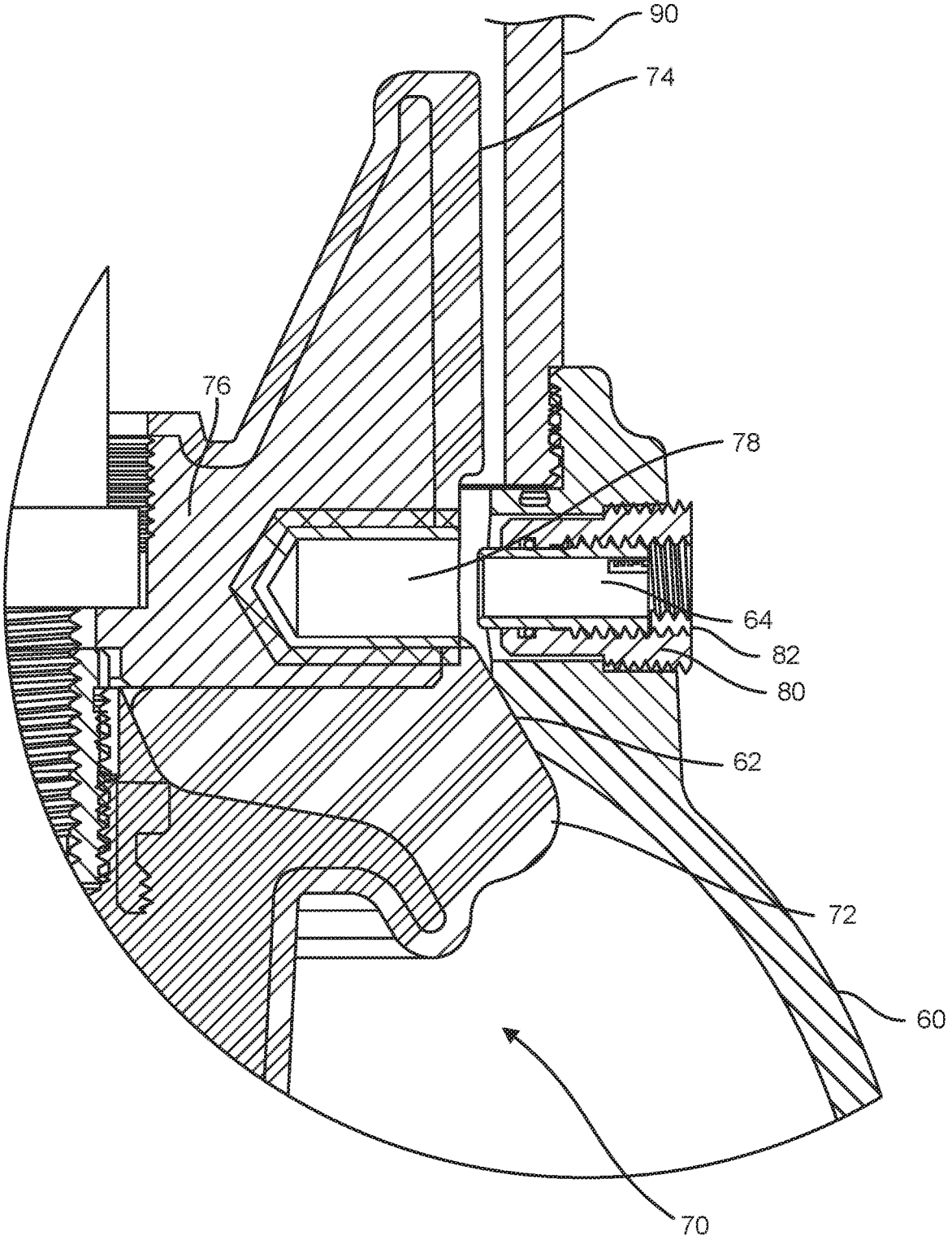
FIG. 3 PRIOR ART
FIG. 3 shows a prior art elbow and main valve assembly, according to another embodiment.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

The terminology used herein is for the purpose of describing particular example embodiments only and is not intended to be limiting. As used herein, the singular forms "a", "an", and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terms "axial" and/or "axially" refer to the relative position/direction of objects along an axis substantially parallel with a center axis of the fire hydrant or other component specified (e.g. fire hydrant elbow). As further used herein, the terms "radial" and/or "radially" refer to the relative position/direction of objects along an axis substantially perpendicular with the center axis. Additionally, the terms "circumferential" and/or "circumferentially" refer to the relative position/direction of objects along a circumference surrounding the center axis.

The term "elastic deformation" is understood to be a reversible change in the dimensions of a material, in which the material has a first set of dimensions when no forces are applied to it, the material transitions to a second set of dimensions when forces are applied to it, and the material transitions back to its original set of dimensions when the forces are no longer applied. Such deformation includes but is not limited to changes in spatial dimensions and combinations thereof (e.g., changes in volume, cross-sectional profile, and diameter), and can result from forces including, but not limited to, forces of compression and/or stretching under tension.

Figure 4:
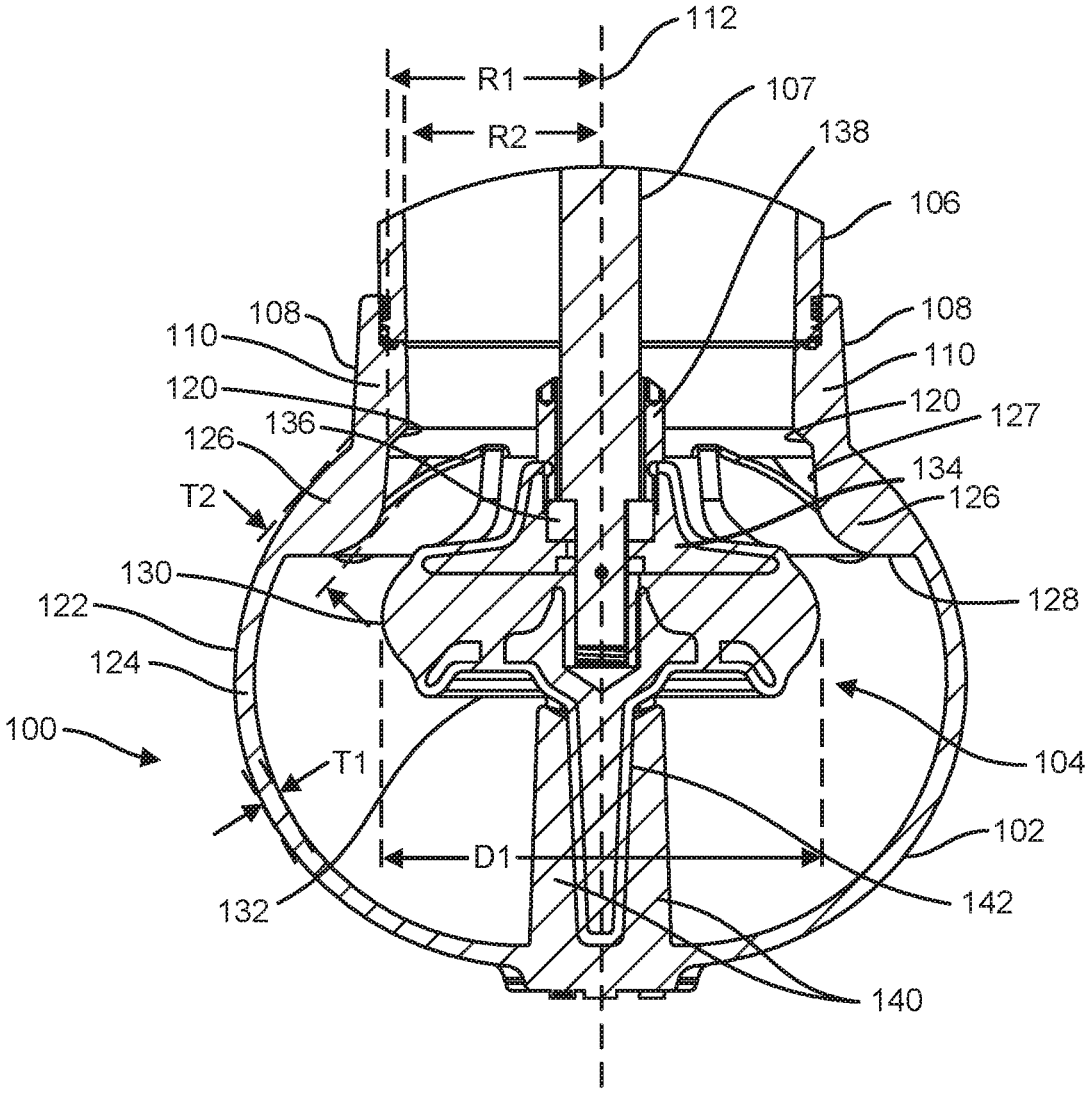
FIG. 4 shows a cross-sectional side view of an elbow and a main valve assembly of a fire hydrant according to an embodiment of the invention, wherein the main valve assembly is in an open position.
Figure 5:
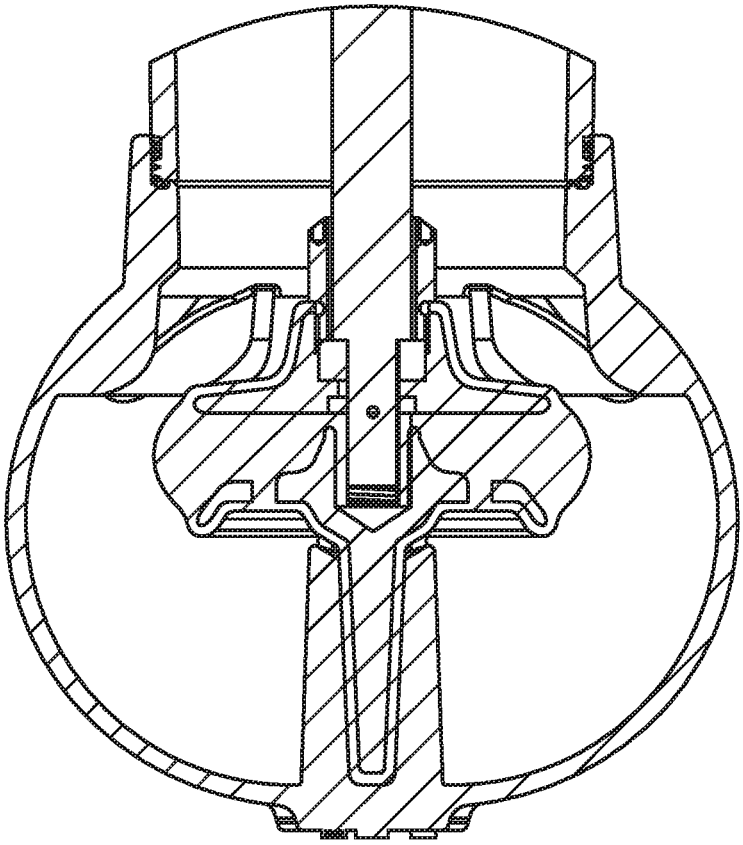
FIG. 5 shows a cross-sectional side view of an elbow and a main valve assembly of the fire hydrant of FIG. 3, wherein the main valve assembly is in a closed position.

FIG. 4 shows a cross-sectional side view of a portion of a fire hydrant 100 including an elbow 102, a main valve assembly 104, and a bottom portion of a lower barrel 106, according to an embodiment of the invention, wherein the main valve assembly 104 is in an open position within the elbow 102. In the open position, fluid can pass the main valve assembly 104 and flow through the elbow 102. FIG. 5 shows a cross-sectional side view of the elbow 102, the main valve assembly 104, and the bottom portion of the lower barrel 106 of the fire hydrant 100 of FIG. 4, wherein the main valve assembly 104 is in a closed position within the elbow 102. In the closed position, fluid is sealed by the main valve assembly 104 and cannot flow through the elbow 102. The fire hydrant 100 according to this example embodiment also includes a stem 107 extending as a shaft between the main valve assembly 104 and a cap (not shown) of the fire hydrant 100. An upper end (not shown) of the stem 107 includes an operating stem nut (not shown), which can be rotated to actuate (i.e., move axially, or raise or lower) the stem 107 and thereby open or close the main valve assembly 104.

Referring to FIGS. 4 and 5, the main valve assembly 104 includes a main valve seal 130, a main valve bottom plate 132, a drain valve body 134, a thrust bearing 136, and a retaining nut 138. The main valve assembly 104 can be moved between the open position (FIG. 4), wherein fluid can pass the main valve seal 130 in route between a water main (not shown) and the lower barrel 106, and a closed position (FIG. 5), wherein the main valve seal 130 closes the fluid path through the elbow 102.

The main valve seal 130 can be formed from an elastomeric material that can be compressed, or alternatively stretched in tension, between the main valve bottom plate 132 and the drain valve body 134. Compression, or stretching under tension of the main valve seal 130 changes an outer diameter D1 of the main valve seal 130 so that the main valve seal 130 can be inserted and removed from the elbow 102 without the need for removable valve seats or valve seat inserts.

The thrust bearing 136 can be threaded onto the stem 107, which can be inserted through the drain valve body 134 and the main valve seal 130, and threaded into the main valve bottom plate 132 until the thrust bearing 136 is received in the drain valve body 134. The main valve bottom plate 132 can be substantially formed as a disk. The retaining nut 138 can be slid over the stem 107 and threaded into the drain valve body 134 to hold the drain valve body 134 in a fixed axial position on the stem 107 while allowing the stem 107 to rotate until the retaining nut 138 is fully tightened.

This arrangement allows the main valve bottom plate 132 to move axially along the stem 107 when the stem 107 is rotated, while the drain valve body 134 remains axially fixed relative to the stem 107. Accordingly, by rotating the stem 107 the thrust bearing 136 forces the drain valve body 134 and the main valve bottom plate 132 closer or farther apart, which compresses or decompress the main valve seal 130 between the main valve bottom plate 132 and the drain valve body 134, in turn altering the main valve seal's outer diameter D1. Closing the distance between the main valve bottom plate 132 and the drain valve body 134 elastically deforms the main valve seal 130, forcing the main valve seal 130 outwardly from the space between the main valve bottom plate 132 and the drain valve body 134.

The retaining nut 138 can be tightened using, for example, an "L" shaped wrench, locking the thrust bearing 136 and stem 107 into the drain valve body 134 such that the stem 107 cannot rotate and loosen the connection between the main valve bottom plate 132 and drain valve body 134 during normal operation of the main valve assembly 104.

A guide 140 can be formed at the bottom of the elbow 102 by two plates, which can extend vertically upward inside the elbow 102. The guide 140 can be formed as an integral portion of the elbow 102 casting as a surface of the elbow 102, or can be constructed separately and affixed, for example by welding, to the desired location in the elbow 102 after the guide 140 and the elbow 102 have been cast.

A blade 142 can extend vertically down from the main valve bottom plate 132. The blade 142 can have a thickness approximately equal to the spacing between the plates of the guide 140 so that the blade 142 can freely move into and out of the guide 140. The geometry and configuration of the blade 142 can vary, and is shown in FIGS. 4 and 5 as a wedge. Other geometries can be used, provided the blade 142 can be received by the guide 140 between the plates. The blade 142 engages the plates of the guide 140 to limit or prevent rotation of the blade 142 and the main valve bottom plate 132 relative to the elbow 102.

Figure 6:
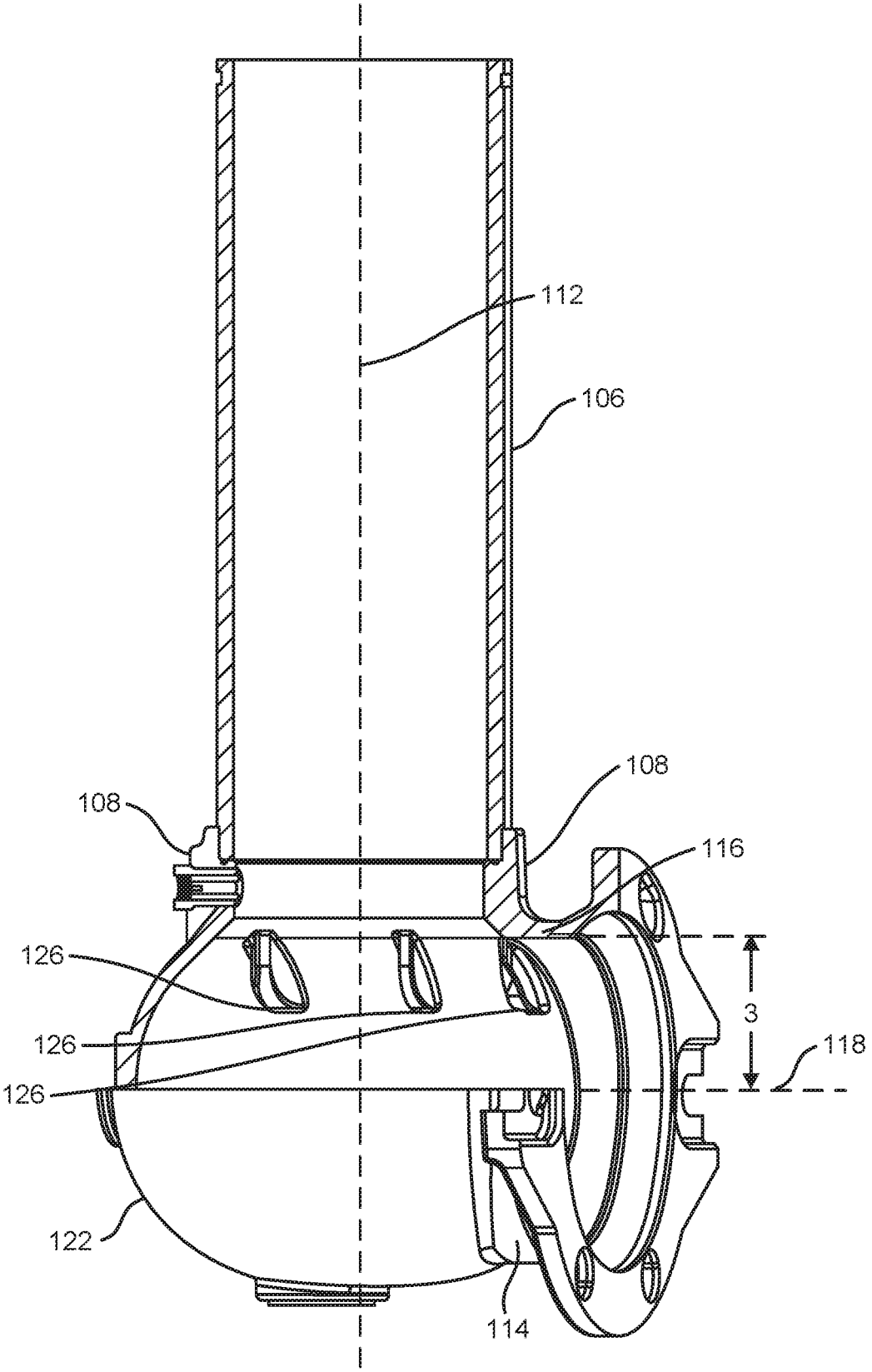
FIG. 6 shows a partial section of the elbow and main valve assembly of the fire hydrant of FIG. 3.

Referring to FIGS. 4 and 5, and further to FIG. 6, which is a partially sectioned view showing the elbow 102 of FIG. 4 and FIG. 5 turned 90 degrees, the elbow 102 connects the lower barrel 106 of the fire hydrant 100 to a water main (not shown). The water main and the lower barrel 106 can be oriented at different angles, typically about 90 degrees. Accordingly, a centered path through the elbow bends a corresponding amount of degrees. The elbow 102 includes a first portion 108 including a first annular wall 110 around a first center axis 112. A second portion 114, which includes a second annular wall 116 around a second center axis 118, is joined with the first portion 108, at an angle corresponding to the appropriate or desired angle between the water main and the lower barrel 106. Typically, the angle is about 90 degrees, such that the first center axis 112 is angled about 90 degrees from the second center axis 118.

A main valve seat 120 provides a surface against which the main valve assembly 104 can be pressed to make a fluid seal, to seal fluid (e.g., water) from traveling between the elbow 102 and the lower barrel 106. The main valve seat 120 faces radially inward toward the first center axis 112 from the first annular wall 110. While the main valve seat 120 can face perpendicular to the first center axis 112, in the depicted embodiment, the main valve seat 120 faces obliquely toward the first center axis 112. This oblique angle can vary. The main valve seat 120 defines a step from a first radius R1 to a second radius R2 (relative to the first center axis 112), the first radius R1 being larger than the second radius R2. The main valve seat 120 can also define a smallest radius of the first portion 108, such that no part of the first portion 108 in the flow path toward the lower barrel 106 downstream of the main valve seat 120 constricts the fluid flow more than the main valve seat 120. In the illustrated embodiment, the second radius R2 is the smallest radius of the first portion 108. The main valve seat 120 can be integrated with the first annular wall 110 by casting as a single piece with the elbow 102, or the main valve seat 120 can be a separate part coupled with the first annular wall 110.

A transition portion 122 of the elbow 102 joins the first portion 108 and the second portion 114. The transition portion 122 includes a wall 124 having a first wall thickness T1. While the transition portion 122 can extend straight from and/or parallel to either or both of the first portion 108 and the second portion 114, and can have a sharper corner, in the illustrated embodiment the wall 124 of the transition portion 122 has a fully curved shape, opening radially outward compared to the first radius R1 or the second radius R2 of the first portion 108 and compared to a radius R3 of the second portion 114. This shape facilitates a larger volume for fluid flow, more space to locate the main valve assembly 104, a less abrupt redirection of the fluid flow path, and room to locate one or more guide ribs 126.

Each guide rib 126 protrudes radially inward toward the first center axis 112 from the wall 124 of the transition portion 122 adjacent the main valve seat 120. Each guide rib 126 is positioned and configured to make contact with a main valve seal 130 of the main valve assembly 104 at an intermediate point or range of a path of the main valve seal 130 between the open position and the closed position. Hence, each guide rib 126 has an innermost radius R3 (in the illustrated embodiment, innermost radius R3=first radius R1) smaller than an outer radius R4 of the main valve seal 130. During closing of the main valve seal 130, rapid fluid flow through the narrowing gap between the main valve seal 130 and the main valve seat 120, according to Bernoulli's Principle, corresponds to a decrease in pressure in this gap. The elastomeric main valve seal 130 is drawn into the gap toward the main valve seat 120, which creates a flapping or bouncing of the main valve seal 130 against the main valve seat 120. Accordingly, the contact between the main valve seal 130 and each guide rib 126 occurs before the main valve seal 130 draws within the determined distance of the main valve seat 120 where the main valve seal 130 would begin to bounce against the main valve seat 120. The contact between each guide rib 126 and the main valve seal 130 stabilizes the main valve seal 130 and reduces or prevents the otherwise bouncing or flapping of the main valve seal 130 against the main valve seat 120, while allowing the main valve seal 130 to continue its path to closing against the main valve seat 120. In order for the main valve seal 130 to abut and close against the main valve seat 120, an inner radius (e.g., second radius R2) of the main valve seat 120 is smaller than the innermost radius R3 (in the illustrated embodiment, innermost radius R3=first radius R1) of each guide rib 126.

The precise position and size of each guide rib 126 can vary depending on the specific configuration of the elbow 102 and the main valve assembly 104, and specifically depending on the configuration of the main valve seat 120 and the main valve seal 130. In the illustrated embodiment, the guide rib protrudes radially inward from the wall 124 of the transition portion 122 at an end of the transition portion 122 that is adjacent the first portion 108. In this depicted embodiment, the guide rib 126 has a first surface 127 oriented approximately parallel with the first center axis 112 of the elbow 102, and a second surface 128 joined with the first surface 127. The second surface 128 can also be oriented approximately parallel with the second center axis 118 of the elbow 102. In this case "approximate" can mean within ten degrees of parallel, within five degrees of parallel, or a smaller range. A rounded or chamfered corner can join the first surface 127 and the second surface 128.

Each guide rib 126 can be a separate piece connected to the wall 124, or integrated as a single piece with the elbow 102 such that each guide rib 126 defines a second wall thickness T2 greater than the first wall thickness T1. More guide ribs 126 provide more support to the main valve seal 130 than fewer guide ribs 126, though more guide ribs 126 also hinder flow of fluid more than fewer guide ribs 126. Likewise, wider guide ribs 126 provide greater support than narrower guide ribs 126, but narrower guide ribs 126 obstruct flow of fluid less than wider guide ribs 126. Each of these characteristics can be balanced or tuned for the best results depending on many factors, such as, but not limited to, water pressure, the configuration of the elbow 102 and each fire hydrant component in the elbow 102, and the resulting level of support necessary to stabilize the main valve seal 130. Further, equally spacing the guide ribs 126 can facilitate relatively uniform support around a circumference of the main valve seal 130 with the fewest guide ribs 126.

In operation of the fire hydrant 100 to close the main valve assembly 104, the operating stem nut (not shown) can be turned to raise the main valve assembly 104 within the elbow 102 toward the lower barrel 106 until the main valve seal 130 mates with the main valve seat 120. Before the main valve seal 130 reaches the main valve seat 120 or the determined distance from the main valve seat 120 at which the main valve seal 130 might be elastically deformed and prematurely drawn into contact with the main valve seat 120, the main valve seal 130 contacts the guide ribs 126. The guide ribs 126 compress the main valve seal 130 an amount sufficient to stabilize the main valve seal 130 and prevent or reduce flapping of the main valve seal 130 against the main valve seat 120. The compression is small enough, though, that an operator is not obstructed or prevented from turning the operating stem nut (not shown) and moving the main valve seal 130 to close against the main valve seat 120. The contact between the main valve seal 130 and each guide rib 126 can continue after initial contact until the main valve seal 130 moves into closed position. In the illustrated embodiment, the first surface 127 of each guide rib 126 extends to the main valve seat 120 in a direction parallel with the first center axis 112, along which the main valve assembly 104 moves from the open position to the closed position, to facilitate the continual contact between the main valve seal 130 and each guide rib 126 from initial contact to seating against the main valve seat 120.

While a specific design for a fire hydrant 100 is shown in the figures and described with respect to the figures, other fire hydrant models that use a stem and operating stem nut to operate a main valve assembly can use inventive concepts described herein.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A fire hydrant elbow comprising:

a first portion including a first annular wall around a first center axis;

a second portion including a second annular wall around a second center axis, the second portion joined with the first portion, the second center axis angled from the first center axis;

a main valve seat facing radially inward toward the first center axis from the first annular wall, the main valve seat defining a step from a first radius to a second radius, the first radius being larger than the second radius; and a guide rib adjacent the main valve seat between the first portion and the second portion, the guide rib protruding radially inward toward the first center axis, the guide rib having two sidewalls, a first surface and a second surface between the two sidewalls, the first surface facing the first center axis, the second surface joined with the first surface at an angle greater than 0 degrees from the first surface.

2. The fire hydrant elbow of claim 1, further comprising:

a transition portion joining the first portion and the second portion, the transition portion having a wall with a first wall thickness, the guide rib protruding radially inward from the wall of the transition portion.

3. The fire hydrant elbow of claim 2, wherein the guide rib protrudes radially inward from the wall of the transition portion at and end of the transition portion adjacent the first portion.

4. The fire hydrant elbow of claim 2, wherein the radially inward protrusion of the guide rib creates a second wall thickness greater than the first wall thickness.

5. The fire hydrant elbow of claim 2, wherein the transition portion expands relative to the first portion radially outward relative to first center axis.

6. The fire hydrant elbow of claim 1, wherein the guide rib is a plurality of guide ribs.

7. The fire hydrant elbow of claim 6, wherein the guide ribs of the plurality of guide ribs are equally spaced around an inner circumference relative to the first center axis.

8. The fire hydrant elbow of claim 1, wherein the first surface is oriented within 10 degrees of parallel with the first center axis.

9. The fire hydrant elbow of claim 8, wherein the first surface is joined with the second surface via a rounded or chamfered corner.

10. The fire hydrant elbow of claim 8, wherein the first surface intersects the main valve seat.

11. The fire hydrant elbow of claim 1, wherein the guide rib is directly adjacent the main valve seat.

12. A fire hydrant comprising:

an elbow including an inner circumference and a main valve seat around the inner circumference; and a main valve assembly in the elbow, the main valve assembly including a main valve seal, the main valve seal configured to abut and seal against an inner circumference of the main valve seat, a guide rib adjacent the main valve seat, the guide rib having an innermost radius greater than an inner radius of the main valve seat, the innermost radius of the guide rib being smaller than an outer radius of the main valve seal.

13. The fire hydrant of claim 12, wherein the main valve seat faces radially inward between the inner circumference and the guide rib, the main valve seat defining a step from a first radius to a second radius, the first radius being larger than the second radius.

14. The fire hydrant of claim 12, wherein the elbow further comprises:

a first portion including a first annular wall around a first center axis;

a second portion including a second annular wall around a second center axis, the second portion joined with the first portion, the second center axis angled from the first center axis; and a transition portion joining the first portion and the second portion, the transition portion having a wall with a first wall thickness, the guide rib protruding radially inward from the wall of the transition portion.

15. The fire hydrant of claim 14, wherein the radially inward protrusion of the guide rib creates a second wall thickness greater than the first wall thickness.

16. The fire hydrant of claim 12, wherein the guide rib is a plurality of guide ribs.

17. The fire hydrant of claim 16, wherein the guide ribs of the plurality of guide ribs are equally spaced around the inner circumference.

18. The fire hydrant of claim 12, wherein the elbow includes a first center axis and a second center axis, and wherein the guide rib comprises:

a first surface oriented parallel with the first center axis of the elbow; and a second surface joined with the first surface, the second surface oriented parallel with the second center axis of the elbow.

19. The fire hydrant of claim 18, wherein the first surface is joined with the second surface via a rounded or chamfered corner.

20. A main valve seal guide for a hydrant, the main valve seal guide comprising:

an annular body having a center axis; and a plurality of guide ribs coupled to the annular body, each guide rib having a first surface and a second surface, the first surface oriented within ten degrees of parallel with the center axis, the second surface joined with the first surface and angled from the first surface, each guide rib extending from the annular body to the first surface.

* * * * *